United States Patent [19]

Gramse

[11] 4,246,849

[45] Jan. 27, 1981

[54] PARTITIONED RAILWAY HOPPER CAR

[75] Inventor: Harold E. Gramse, Chicago Heights, Ill.

[73] Assignee: Pullman Incorporated, Chicago, Ill.

[21] Appl. No.: 92,164

[22] Filed: Nov. 7, 1979

Related U.S. Application Data

[63] Continuation of Ser. No. 839,222, Jan. 4, 1977, abandoned.

[51] Int. Cl.[3] ..... B61D 7/04; B61D 7/08; B61D 7/18

[52] U.S. Cl. ..... 105/251; 105/248; 105/406 R; 105/411

[58] Field of Search ..... 105/4 R, 247, 248, 250, 105/251, 253, 406 R, 410, 411

[56] References Cited

U.S. PATENT DOCUMENTS

| | | | |
|---|---|---|---|
| 975,861 | 11/1910 | Harrigan | 105/406 R X |
| 1,422,133 | 7/1922 | Robider | 105/248 |
| 2,970,553 | 2/1961 | Allen | 105/410 |
| 2,989,929 | 6/1961 | Flowers | 105/4 R |
| 3,127,851 | 4/1964 | Auksel | 105/248 |
| 3,253,556 | 5/1966 | Glaser et al. | 105/410 |
| 3,596,608 | 8/1971 | Aquino et al. | 105/253 X |
| 3,710,730 | 1/1973 | Austgen et al. | 105/251 X |
| 3,769,910 | 11/1973 | Przyblinski et al. | 105/248 |
| 3,868,913 | 3/1975 | Becker et al. | 105/251 X |

*Primary Examiner*—Howard Beltran

*Attorney, Agent, or Firm*—Richard J. Myers; Stephen D. Geimer

[57] ABSTRACT

An open top railway hopper car is provided with a car body having the usual end slope sheets and lower side discharge openings. Transverse bulkheads spaced above the end slope sheets to provide the car with a rectangular center compartment particularly adapted to have elongated cargo such as logs and also provide an opening for end compartments which are filled and discharged when the car is used to haul cargo such as wood chips and the like.

8 Claims, 4 Drawing Figures

10
20
20
19
11
46
A
18
18
42
24
29
17
23
40
43
17
41
22
44
15
15
23
21
13
16
12
21
34

PARTITIONED RAILWAY HOPPER CAR

This is a continuation of application Ser. No. 839,222 filed Jan. 4, 1977, now abandoned.

BACKGROUND OF THE INVENTION

1. Field of the Invention

The invention generally concerns open top railway hopper cars having side discharge doors and openings. More specifically the invention relates to a hopper car particularly adapted for carrying large elongated objects in a central compartment but which also is readily adapted for carrying finely divided or comminuted materials in the central compartment and also in the area above the end slope sheets.

2. Description of the Prior Art

The Prior art is typified by U.S. Pat. Nos. 3,596,608, Aug. 3, 1971, 3,710,730, Jan. 16, 1973 and 3,868,913, Mar. 4, 1975, all of which illustrate open top railway hopper cars having longitudinally disposed discharge gates. However, none of these patents show an arrangement as in the subject invention in which internal bulkheads subdivide interior portions of the hopper structure to accommodate transportation of elongated loads.

SUMMARY OF THE INVENTION

The railway hopper car of the present invention is of the open top type. It has a plurality of longitudinally extending side discharge openings and doors for discharging materials from the inside of the car. The car includes a body which is divided into a central compartment and two end compartments disposed on opposite ends of the central compartment at opposite ends of the car. This division is provided by a pair of end bulkheads located at each end of the car and extending upwardly from the side sill to the side plate. The central compartment is divided into side-by-side hoppers by a longitudinally extending upright divider wall which is mounted atop the center sill and terminates at and is connected to the end bulkheads.

As mentioned, end bulkheads extend from the upper, open top downwardly and terminates slightly above the lower side sills of the car to provide an opening underneath each bulkhead which provide for each end compartment to communicate with the central compartment. The end compartments formed by the bulkheads include end slope sheets which can channel cargo within the end compartments through the bulkhead openings into the center compartment space and then outwardly through the side discharge openings.

The present invention is particularly adapted for carrying cargo of great length, such as logs, in the central compartment which can be rapidly discharged. Or, the car can carry large quantities of comminuted, bulk materials such as wood chips and the like which are easily discharged and dumped from the central and end compartments.

DESCRIPTION OF THE PREFERRED EMBODIMENT

Figure 1:
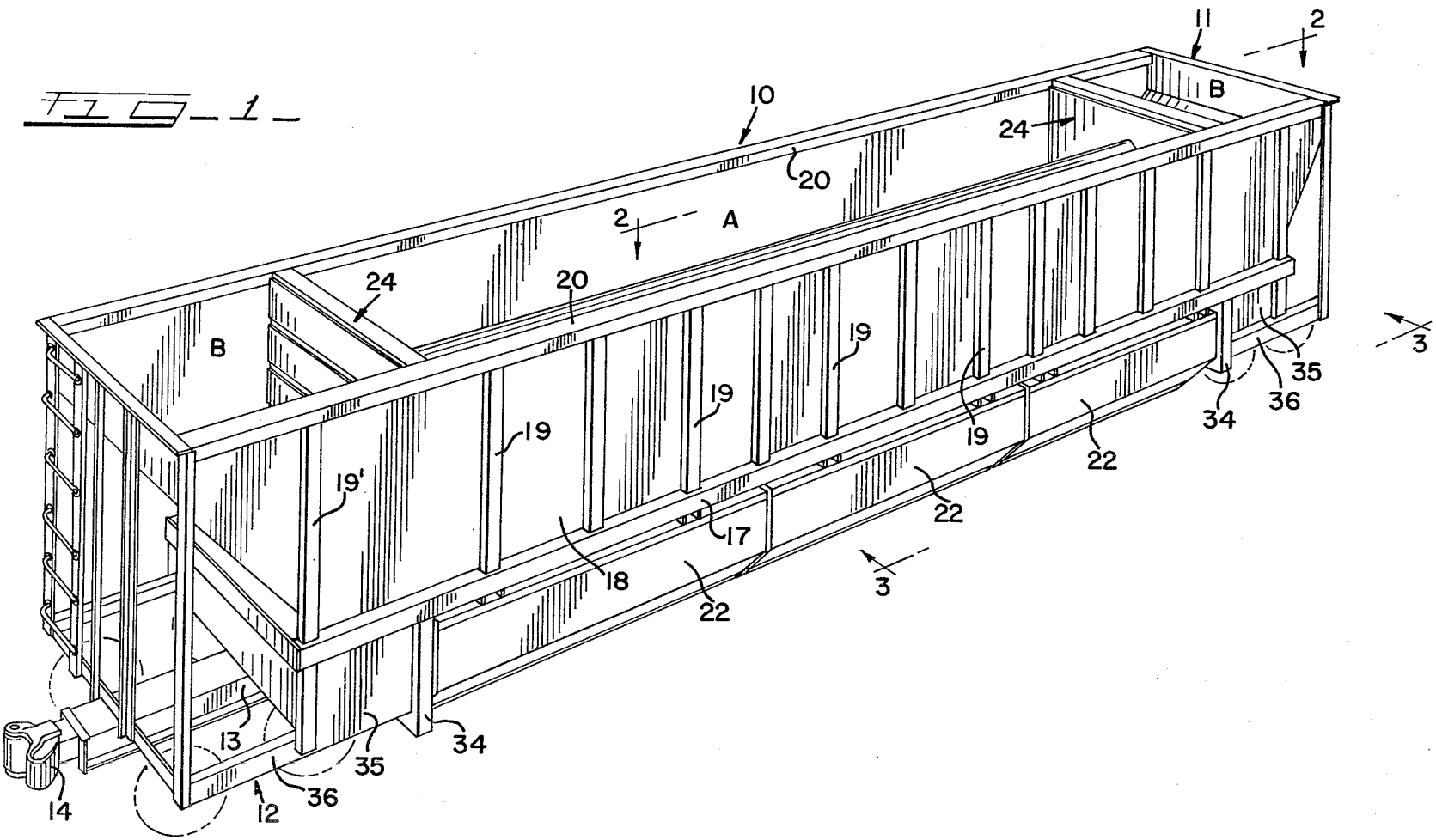
FIG. 1 is a perspective view of a open top railway hopper car of the present invention.
Figure 2:
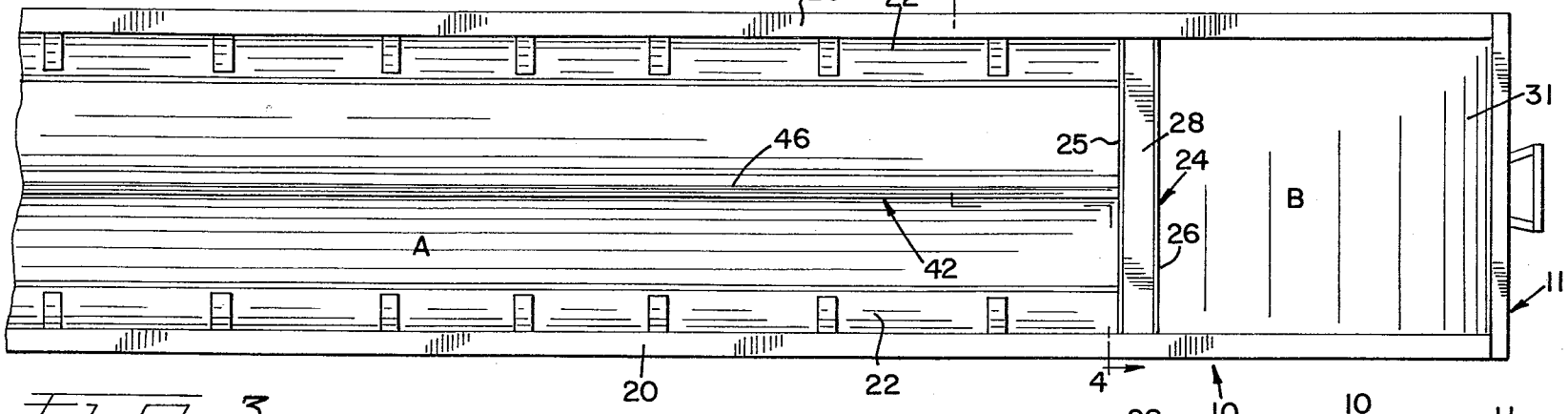
FIG. 2 is a plan view of a portion of the car taken along the line 2—2 of FIG. 1.

FIG. 1 disclose a railway hopper car 10 of the open top type including a car body 11 supported on an underframe structure 12. The underframe structure 12 comprises a center sill 13 provided at its ends with a suitable coupler 14 which may also include conventional end of car cushioning means. A pair of longitudinally extending hopper discharge slope sheets 15 diverge downwardly and outwardly and are rigidly supported on the center sill by transverse channel supports or beams 16 longitudinally spaced along the underframe structure.

The underframe structure includes the conventional car body bolster and truck bolster arrangement (not shown) and is supported on conventional wheel truck assemblies.

The body 11 includes lower side sills 17, side wall sheathing 18, vertical side posts 19 and upper tubular beams or side plates 20. The side sills 17 and lower ends of the hopper discharge slope sheets 15 define side discharge openings 21. Closure doors 22 are hingedly connected as indicated at 23 to the side sills 17. The doors are movable by gravity of the load to an open position for discharging materials. Suitable locking and release mechanisms are provided (not shown), these are not forming any part of the present invention.

The interior of the railway car 10 is divided into a central compartment A, and two end compartments B. A pair of bulkheads 24 are provided within the car 10 and are spaced inwardly from opposite end slope sheets 31. Each bulkhead 24 comprises a smooth inner wall 25 and an outer wall 26 said outer wall consisting of a plurality of spaced board sections. The outer wall 26 is spaced with respect to the inner wall 25 by means of a plurality of horizontal hat shaped reinforcement members 27.

An upper channel shaped cap 28 closes the upper end of each bulkhead and a V-shaped cap 29 closes the lower end. The bulkheads 24 extend downwardly from the side plates 20 and terminate just above the side sills 17 providing an opening 30 therebelow which provides for communication between compartments A and B.

The end compartments B include an inwardly and downwardly sloping wall or end slope sheets 31 and vertical end wall portion 32. An extension 33 projects below each bulkhead 24 and merges with the discharge openings 21 to direct and channel cargo material from the compartments B through the discharge openings 21.

Figure 4:
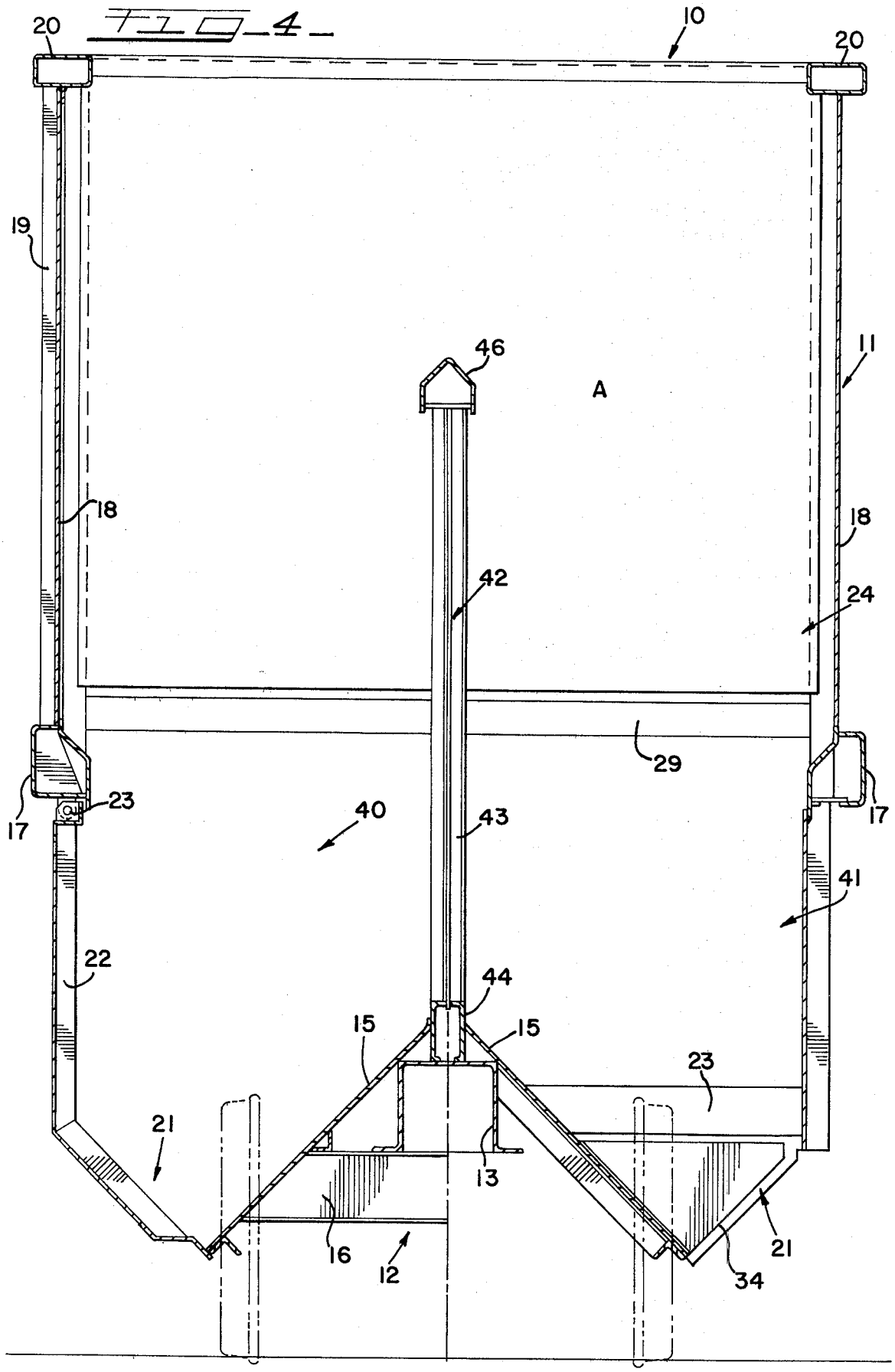
FIG. 4 is a cross-sectional view taken along the line 4—4 of FIG. 2.

As best shown in FIGS. 1 and 4, the ends of the discharge openings 21 are provided with support structures 34 connected to vertical shear panels 35 also connected to bolster connected end parts 19' in turn connected to car side sill structure 36.

Figure 3:
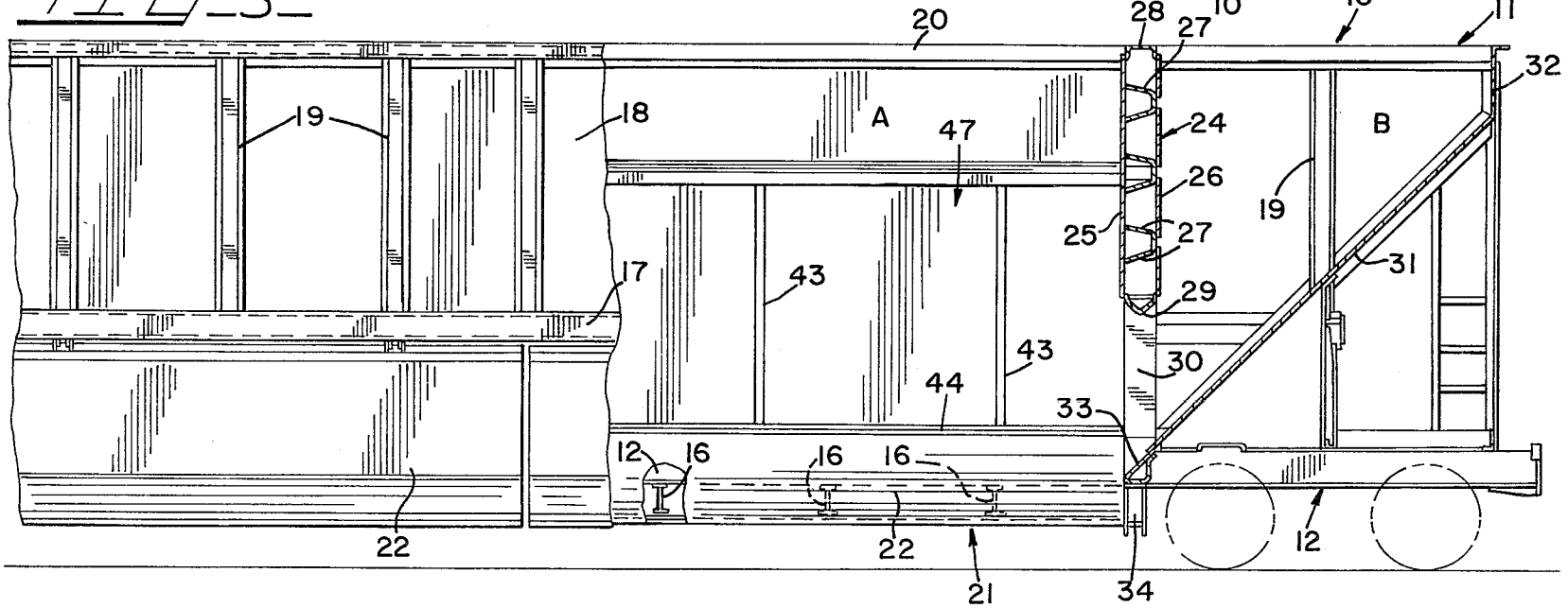
FIG. 3 is a side elevational view of the railway car with portions broken away, as viewed in the direction of the line 3—3 of FIG. 1, to illustrate the invention.

As best shown in FIGS. 3 and 4 the central compartment A is divided into side-by-side hoppers 40 and 41 by means of a divider wall 42. The wall 42 comprises a plurality of upright post members 43 supported on a rectangular tubular spine member 44 rigidly connected to the center sill 13 and upper ends of the sloping hopper discharge slope sheets 15.

Wall panels 47 (FIG. 3) are connected to the spine member 44 and upright post members 43. A longitudinal top cap member 46 is secured over the length of the divider wall structure 42.

THE OPERATION

The present open top hopper car is especially suited for carrying and transporting cargo consisting of wood chips, granulated materials and others of a similar nature.

The entire car including compartments A and B may be fully loaded and when the load has reached its destination it is discharged with the material in compartments B being directed and funnelled through the opening 30 in the bulkheads and outwardly through the discharge openings.

The A compartment is ideal for handling large pieces such as pulp wood, any other kinds of lumber, etc. which will stack in each of the hoppers of the A compartment. The bulkheads 24 will prevent longitudinal shifting and the smoother inner panels of the bulkhead assist in the quick discharge of the load when the discharge doors are opened. Thus the rail car described is highly advantagious in lumbering operations when it must serve a variety of purposes.

What is claimed is:

1. A railway hopper car including a center sill and underframe arrangement, a car body supported on said underframe arrangement, the improvement comprising:

longitudinally extending, laterally spaced raised side sills spaced substantially above said center sill and having upright side walls connected thereto, end wall structure on opposite ends of said car body including an end wall and end slope sheets extending downwardly and inwardly in sloping relation from said end wall, a pair of longitudinally extending hopper discharge slope sheets supported on said center sill and extending downwardly and outwardly of the center sill in sloping relation, the lower ends of said longitudinal slope sheet and said raised side sills providing therebetween a pair of enlarged, oppositely disposed hopper discharge openings extending from the side sills to the hopper discharge slope sheets, discharge doors pivotally supported on said side sills above said discharge openings and each having a vertically extending sidewall portion and terminating in an inwardly and downwardly sloping bottom portion, a pair of end bulkheads each extending transversely of the car and spaced from the end slope sheets to provide a bulkhead opening in a transverse plane, said end bulkheads being inwardly spaced from opposite end walls of the car body to provide a central compartment communicating with said discharge openings, an end compartment at each end of the central compartment of the car and being defined by the end bulkhead end slope sheet and end wall, said end compartment being capable of storing comminuted material and being emptied by communication between said end and central compartments to accommodate the discharge of materials from said end compartment through said hopper discharge openings, and divider wall means having a lower beam portion attached atop the center sill and extending longitudinally to interconnect said spaced end bulkheads, said divider wall means including a vertical portion extending from below the raised side sill to a point substantially above the raised side sill and cooperating with the vertically extending portions of said doors to provide narrow elongated hoppers suitable for receiving large elongated objects such as logs or the like.

2. The invention in accordance with claim 1, said bulkhead openings being disposed adjacent opposite ends of said discharge openings.

3. The invention in accordance with claim 1, said car body being open at its top and said bulkheads extending from said open top to a point adjacent to said side sills.

4. The invention in accordance with claim 1, which includes means connecting the upper portions of said longitudinal slope sheets to said divider wall, and longitudinally spaced and laterally extending support beams positioned beneath and secured to said center sill for supporting said longitudinal slope sheets.

5. The invention in accordance with claim 1, wherein each of said end bulkheads includes a flat vertical inner wall portion, a second vertical outer wall spaced longitudinal from said inner wall, and transversely extending reinforcing members connecting said inner and outer walls.

6. The invention in accordance with claim 5, said flat inner vertical wall portions of said bulkhead being positioned at the opposite longitudinal ends of said longitudinal slope sheets and said discharge openings.

7. The invention in accordance with claim 6, said end slope sheets having lower diagonal portion terminating at the ends of said discharge openings for directing material from said end compartment through said bulkhead openings and discharge openings.

8. The invention in accordance with claim 7, said reinforcing members of said bulkhead including hat shape beam sections extending horizontally.

* * * * *